US009456653B2

(12) United States Patent
Ueda

(10) Patent No.: US 9,456,653 B2
(45) Date of Patent: Oct. 4, 2016

(54) BICYCLE SHOE SUPPORT AND BICYCLE SHOE

(71) Applicant: Yutaka Ueda, Osaka (JP)
(72) Inventor: Yutaka Ueda, Osaka (JP)
(73) Assignee: Shimano Inc., Osaka (JP)

( * ) Notice: Subject to any disclaimer, the term of this patent is extended or adjusted under 35 U.S.C. 154(b) by 461 days.
(21) Appl. No.: 13/651,057
(22) Filed: Oct. 12, 2012
(65) Prior Publication Data
US 2014/0101975 A1 Apr. 17, 2014
(51) Int. Cl.
*A43B 13/22* (2006.01)
*A43B 5/00* (2006.01)
*A43B 5/14* (2006.01)
*A43B 7/14* (2006.01)
*A43B 13/14* (2006.01)
(52) U.S. Cl.
CPC ..... *A43B 5/14* (2013.01); *A43B 7/1495* (2013.01); *A43B 13/141* (2013.01)
(58) Field of Classification Search
CPC ..... A43B 5/14; A43B 7/1495; A43B 13/141
USPC ..... 36/72 R, 131, 132, 134
See application file for complete search history.

(56) References Cited

U.S. PATENT DOCUMENTS 2,076,316 A * 4/1937 Beals, Jr. ..... A43B 5/18 36/135
3,012,343 A * 12/1961 Dinkel ..... A43B 5/18 36/130
3,355,823 A * 12/1967 Vogt ..... A43C 15/06 12/142 R
4,989,350 A * 2/1991 Bunch ..... A43B 7/20 36/114
5,105,683 A * 4/1992 Mercat ..... B62M 3/086 36/131
5,152,082 A * 10/1992 Culpepper ..... A43B 7/14 36/114
5,211,076 A * 5/1993 Baume ..... B62M 3/086 36/131
5,400,529 A * 3/1995 Bell ..... A43B 5/00 36/114
5,588,228 A * 12/1996 Foscaro ..... A43B 5/0482 36/117.3
5,685,093 A * 11/1997 Lin ..... A43B 1/0054 36/131
D394,740 S * 6/1998 Poust ..... D2/909
5,813,143 A * 9/1998 Bell ..... A43C 15/06 36/59 R
5,878,514 A * 3/1999 Ueda ..... A43B 5/14 36/131
5,896,683 A * 4/1999 Foxen ..... A43B 7/20 36/89
6,009,641 A * 1/2000 Ryan ..... A43B 5/14 36/107
6,170,175 B1 * 1/2001 Funk ..... A43B 5/04 36/115
6,260,291 B1 * 7/2001 Farys ..... A43B 5/14 36/107
6,286,233 B1 * 9/2001 Gaither ..... A43C 1/00 36/50.1
6,701,644 B2 * 3/2004 Oorei ..... A43B 5/00 36/129
6,973,746 B2 * 12/2005 Auger ..... A43B 1/0072 36/128

(Continued)

FOREIGN PATENT DOCUMENTS

EP 0821890 A1 2/1998
JP 8-214905 A 8/1996

OTHER PUBLICATIONS

The Free Dictionary by Farlex, 2003-2016, http://www.thefreedictionary.com/rigid.*

*Primary Examiner* — Clinton T Ostrup
*Assistant Examiner* — Cameron A Carter
(74) *Attorney, Agent, or Firm* — Global IP Counselors

(57) ABSTRACT

A bicycle shoe support includes a rigid support frame and a flexible support member. The rigid support frame has a cleat attachment section, a heel section and a pair of side sections. The heel section is arranged with respect to the cleat attachment section. The side sections longitudinally extend between the cleat attachment section and the heel section to define a foot receiving space therebetween. The flexible support member extends beneath the foot receiving space.

22 Claims, 4 Drawing Sheets

(56) References Cited

U.S. PATENT DOCUMENTS 7,219,451 B2 * 5/2007 Chretien ..... A43B 5/14 36/131
7,234,251 B2 * 6/2007 Fuerst ..... A43B 1/0027 36/11.5
7,343,701 B2 * 3/2008 Pare ..... A43C 1/06 36/50.1
7,380,354 B2 * 6/2008 Yamashita ..... A43B 5/00 36/50.1
D620,237 S * 7/2010 Carbajal ..... D2/909
2002/0088144 A1 * 7/2002 Katz ..... A43C 11/14 36/88
2004/0250445 A1 * 12/2004 Pritchett ..... A43B 3/16 36/2.6
2005/0022430 A1 * 2/2005 Terry ..... A43B 1/0081 36/72 R
2005/0022432 A1 * 2/2005 Chretien ..... A43B 5/14 36/131
2005/0188567 A1 * 9/2005 Chretien ..... B62M 3/086 36/131
2005/0210712 A1 * 9/2005 Jau ..... A43B 5/14 36/131
2006/0080862 A1 * 4/2006 Hay ..... A43B 7/142 36/25 R
2008/0189987 A1 * 8/2008 Geisser ..... A43C 15/09 36/114
2009/0071037 A1 * 3/2009 Foxen ..... A43B 7/20 36/89
2009/0083993 A1 * 4/2009 Plank ..... A43B 3/0078 36/7.3
2009/0249653 A1 * 10/2009 Gunthel ..... A43B 3/0094 36/127
2010/0083535 A1 * 4/2010 Meschter ..... A43B 7/1495 36/88
2010/0107451 A1 * 5/2010 Kay ..... A43B 5/14 36/135
2010/0301632 A1 * 12/2010 Bryne ..... A43B 5/14 296/180.1
2011/0047829 A1 * 3/2011 Bell ..... A43B 5/18 36/134
2011/0099847 A1 * 5/2011 Koe-Krompecher .... A43B 5/00 36/127
2011/0154690 A1 * 6/2011 Walsh ..... A43B 5/001 36/134
2011/0185598 A1 * 8/2011 Tsen ..... A43B 3/22 36/135
2011/0289799 A1 * 12/2011 Keating ..... A43B 7/144 36/103
2012/0324762 A1 * 12/2012 Soumokil ..... A43B 1/0027 36/103
2013/0312290 A1 * 11/2013 Donald ..... A43B 3/16 36/131

* cited by examiner

BICYCLE SHOE SUPPORT AND BICYCLE SHOE

BACKGROUND

1. Field of the Invention

This invention generally relates to a bicycle shoe support. More specifically, the present invention relates to a bicycle shoe support for a bicycle shoe.

2. Background Information

Bicycle shoes preferably include a cleat structure that attaches to a binding structure of a bicycle pedal of a bicycle. The cleat structure of the bicycle shoes can include a cleat that releasably attaches to a cleat engaging portion of the binding structure. The cleats are fixedly coupled to shoe soles of the bicycle shoes. There is a need for bicycle shoes to include sufficiently stiff shoe soles to efficiently transfer pedaling power from rider's feet to the bicycle pedals via the cleats.

There is also a need for bicycle shoes to ensure a snug fit around rider's feet such that the rider's feet do not move around in the bicycle shoes while pedaling. Bicycle shoes include one or more fixing straps or other fastening structure for securing the bicycle shoes to rider's feet. On the other hand, it is sometimes difficult to achieve the snug fit between bottoms of the rider's feet and the shoe soles while utilizing the stiff shoe soles. Conventionally, cushioning insoles are utilized to fill the spaces between the rider's feet and the shoe soles. However, cushioning insoles may absorb pedaling power from the rider's feet. Thus, for the bicycle shoes, little or no cushioning in the insoles is desired.

In view of the above, it will be apparent to those skilled in the art from this disclosure that there exists a need for an improved bicycle shoe. The present disclosure addresses this need in the art as well as other needs, which will become apparent to those skilled in the art from this disclosure.

SUMMARY

One aspect is to provide to a bicycle shoe support that aids an efficient power transfer while maintaining a snug fit to a rider's foot.

In view of the state of the known technology, a bicycle shoe support is provided that basically includes a rigid support frame and a flexible support member. The rigid support frame has a cleat attachment section, a heel section and a pair of side sections. The heel section is arranged with respect to the cleat attachment section. The side sections longitudinally extend between the cleat attachment section and the heel section to define a foot receiving space therebetween. The flexible support member extends beneath the foot receiving space.

Other objects, features, aspects and advantages of the disclosed bicycle shoe support will become apparent to those skilled in the art from the following detailed description, which, taken in conjunction with the annexed drawings, discloses selected embodiments of the bicycle shoe support.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
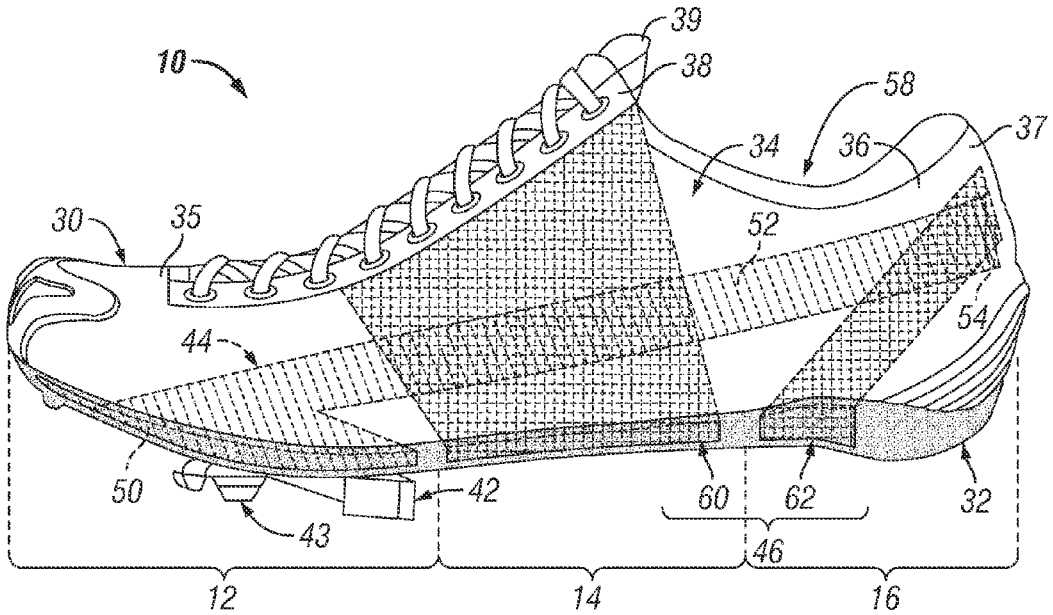
FIG. 1 is a side elevational view of a bicycle shoe having a bicycle shoe support in accordance with a first embodiment.

Referring initially to FIG. 1, a bicycle shoe 10 is illustrated in accordance with a first embodiment. The bicycle shoe 10 is releasably secured to a shoe binding structure of a bicycle (not shown) in a conventional manner. Since the bicycle and the shoe binding structure are not essential elements, further description thereof is omitted for the sake of brevity.

Figure 2:
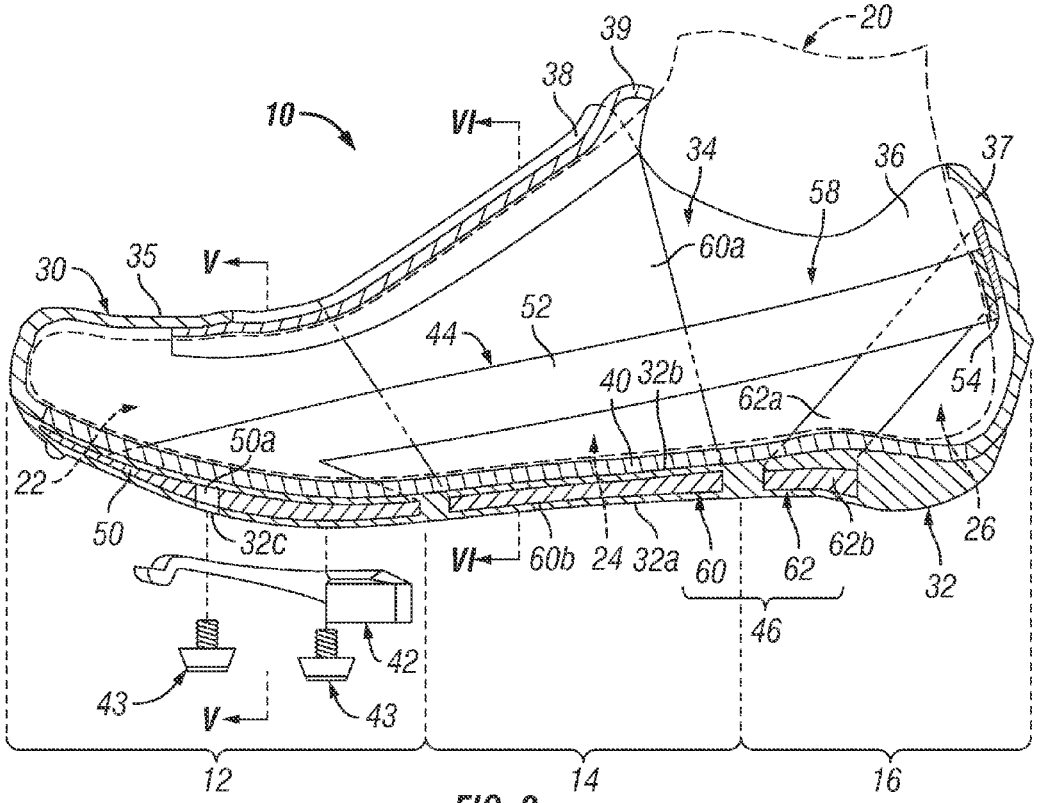
FIG. 2 is a longitudinal cross sectional view of the bicycle shoe illustrated in FIG. 1, illustrating a rider's foot disposed in a foot receiving space of the bicycle shoe.

Referring further to FIGS. 1 and 2, a detailed description of the bicycle shoes 10 is now provided. In the illustrated embodiment, it is noted that the proportions between the parts of the bicycle shoes 10 and the thickness of the parts are not accurate. That is, these proportions and the thickness are exaggerated for the purpose of illustration. Furthermore, there are two bicycle shoes 10. However, the bicycle shoes 10 are identical to one another except that they are mirror images of one another, one for the left foot and one for the right foot. Accordingly, description of one of the bicycle shoes 10 applies equally to the other of the bicycle shoes 10. Therefore, description will be provide for only one of the bicycle shoes 10 (a right bicycle shoe 10), but applies equally to both bicycle shoes 10.

As shown in FIGS. 1 and 2, the bicycle shoe 10 has a toe area 12, an arch area 14 and a heel area 16. The toe area 12 and the heel area 16 are spaced apart in a longitudinal axis of the bicycle shoe 10 that extends between the toe area 12 and the heel area 16, while the arch area 14 is positioned between the toe area 12 and the heel area 16 along the longitudinal axis. The toe area 12 of the bicycle shoe 10 receives a toe portion 22 of a rider's foot 20 while a rider wears the bicycle shoe 10. The arch area 14 of the bicycle shoe 10 receives an arch portion 24 of the rider's foot 20 while the rider wears the bicycle shoe 10. The heel area 16 of the bicycle shoe 10 receives a heel portion 26 of the rider's foot 20 while the rider wears the bicycle shoe 10.

The bicycle shoe 10 mainly has a shoe upper 30, a shoe sole 32 coupled to the shoe upper 30 and a bicycle shoe support 34. The shoe upper 30 is made of any suitable natural or polymetric materials. The shoe upper 30 is formed of an expandable material. In particular, the shoe upper 30 has a top portion 35, a pair of side portions 36 and a heel portion 37. The top portion 35, the side portions 36 and the heel portion 37 of the shoe upper 30 are basically made of nylon mesh or any other flexible and elastic material that is utilized for conventional shoe uppers or socks. These portions of the shoe upper 30 can also be a light weight ventilated material. The side portions 36 at least partially form inboard and outboard sides of the bicycle shoe 10, respectively. Hence, the inboard side and the outboard side refer to both the bicycle shoe 10 and the shoe upper 30. The heel portion 37 extends between the side portions 36. The side portions 36 and the heel portion 37 define an outer peripery of the bicycle shoe 10. It should be understood from the drawings and the description herein that the term inboard side refers to the right side of a shoe for the left foot, and the left side of a shoe for the right foot. In other words the inboard side is the side of the shoe facing the shoe on the other foot of the wearer. Similarly, the term outboard side refers to the left side of the shoe for the left foot and the right side of the shoe for the right foot. The outboard side is the side of the shoe facing away from the shoe on the other foot. As well, the terms inner side and inboard side are used interchangeably with respect to the present disclosure. Similarly, the terms outer side and outboard side are also used interchangeably with respect to the description of the present disclosure.

The shoe upper 30 is reinforced in places with synthetic leather or other material. In particular, the shoe upper 30 has a pair of lacing portions 38 and a tongue 39 along a center of the top portion 35 of the bicycle shoe 10, as a fastening structure for securing the bicycle shoe 10 to the rider's foot 20. Alternatively, the shoe upper 30 can include one or more fixing straps having a hook and loop fastener attachment with fabric hook and loop fastening materials. These fastening structures for securing bicycle shoes to rider's feet are conventionally well-known structures. Thus, detail description of the fastening structures are omitted for the sake of brevity. The various portions of the shoe upper 30 are stitched or otherwise fixed to one another. Since the present disclosure is applicable to a variety of differing shoe styles, designs and configuration, the depicted embodiment shows a basic shoe design that is made of several textile based materials that are sewn or stitched together to form the depicted shape. However, the present disclosure is not limited to the depicted shape, as will be understood from the description of the present disclosure below.

The shoe sole 32 supports the shoe upper 30. Specifically, the shoe sole 32 is fixedly coupled to the shoe upper 30 in a conventional manner, such as with stitching, adhesives, and/or embedding portions thereof within the shoe sole 32. In the illustrated embodiment, the shoe sole 32 is disposed at the toe area 12, the arch area 14 and the heel area 16 of the bicycle shoe 10 along the longitudinal axis. In the illustrated embodiment, the bicycle shoe 10 is a road shoe. Thus, the shoe sole 32 has a smooth bottom surface 32*a*. On the other hand, the bicycle shoe 10 can be an off-road or MTB shoe. In this case, the shoe sole 32 can be an off-road or MTB shoe sole in which a cleat is recessed from the bottom surface of the shoe sole 32 such that the cleat does not contact the ground while walking.

The shoe sole 32 is made of rubber or any suitable soft material to support the shoe upper 30. The shoe sole 32 is at least partially reinforced by the rigid support frame 44 at the toe area 12 of the bicycle shoe 10, while remaining flexible at the arch area 14 and the heel area 16 of the bicycle shoe 10. In the illustrated embodiment, the shoe sole 32 is integrally formed as a one-piece, unitary member having a uniform rigidity. On the other hand, the shoe sole 32 can include a rigid front part at the toe area 12 of the bicycle shoe 10, and a soft or flexible rear part at the arch area 14 and the heel area 16 of the bicycle shoe 10. In this case, the rigid front part can be made of a resilient but relatively rigid polymer or plastic material (with some small degree of resilient flexibility). An inner liner 40 is disposed on an upper or inside surface 32*b* of the shoe sole 32 to cover the upper surface 32*b* of the shoe sole 32 at the toe area 12, the arch area 14 and the heel area 16 of the bicycle shoe 10. Thus, the inner liner 40 is disposed at a location above the bicycle pedal (not shown). On the other hand, the inner liner 40 can only be disposed at the toe area 12 of the bicycle shoe 10. When the inner liner 40 is disposed at the arch area 14 and the heel area 16 of the bicycle shoe 10, little or no cushioning in the inner liner 40 is necessary for snugly fitting the shoe sole 32 to the rider's foot 20 as described below.

In the illustrated embodiment, a cleat 42 is detachably coupled to the bottom surface 32*a* of the shoe sole 32. The cleat 42 is also releasably engaged with the shoe binding structure of the bicycle. The cleat 42 is a road cleat with a plurality of (e.g., three in this embodiment) attachment points. However, for the off-road or MTB bicycle shoes, the cleat can be an off-road or MTB cleat. Since the cleat 42 is conventional, the detailed descriptions of the cleat 42 will be omitted for the sake of brevity. The cleat 42 is mounted to the bottom surface 32*a* of the shoe sole 32 at the toe area 12 of the bicycle shoe 10 in a conventional manner. In particular, the cleat 42 is detachably coupled to the bicycle shoe 10 with a plurality of (e.g., three in this embodiment) screws 43. Since the attachment of the cleat 42 is conventional, the detail descriptions of the attachment of the cleat 42 will be omitted for the sake of brevity.

As shown in FIGS. 1 and 2, the bicycle shoe support 34 includes a rigid support frame 44 and a flexible support member 46. The bicycle shoe support 34 partially reinforces the bicycle shoe 10 in places where the rigidity is required, while increasing the flexibility of the bicycle shoe 10 in other places for a snug fit of the rider's foot 20 to the bicycle shoe 10. The bicycle shoe support 34 forms a bone frame of the bicycle shoe 10, and defines the toe area 12, the arch area 14, and the heel area 16 of the bicycle shoe 10. In the illustrated embodiment, the bicycle shoe support 34 is applied to road shoes. However, the bicycle shoe support 34 is also applicable to off-road shoes.

The rigid support frame 44 includes a cleat attachment section 50, a pair of side sections 52 and a heel section 54. The flexible support member 46 is fixedly attached to the side sections 52 of the rigid support frame 44. The rigid support frame 44 is integrally formed as a one-piece, unitary member. Alternatively, the rigid support frame 44 can also be formed from a plurality of separate members. The rigid support frame 44 is made of carbon graphite. Alternatively, the rigid support frame 44 can also be made of any other suitable rigid material for the rigid support frame 44, such as glass fiber, injection-molding resin, or metal.

Figure 3:
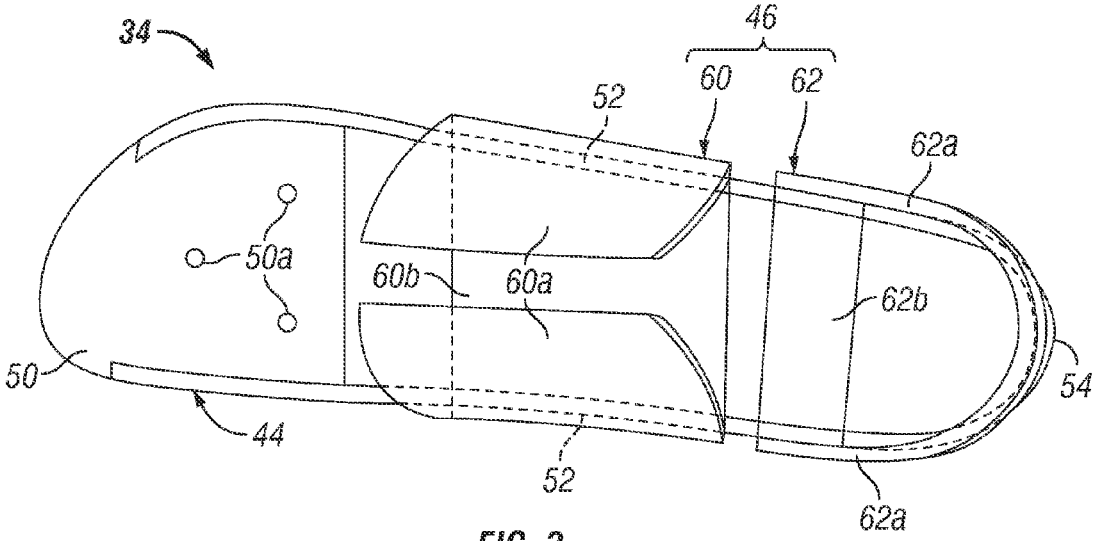
FIG. 3 is a top plan view of the bicycle shoe support of the bicycle shoe illustrated in FIG. 1.
Figure 4:
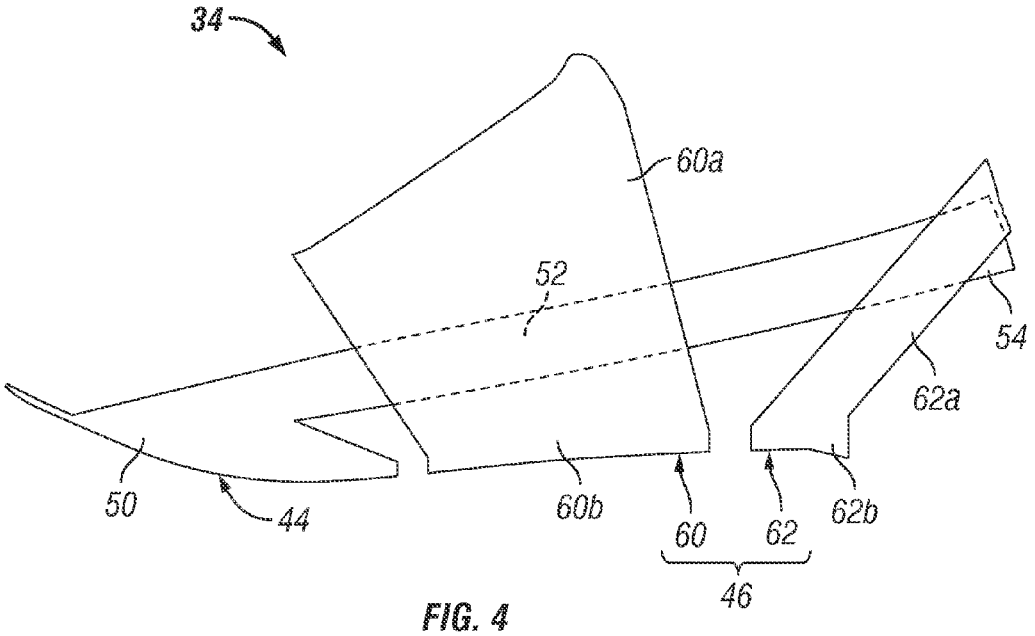
FIG. 4 is a side elevational view of the bicycle shoe support of the bicycle shoe illustrated in FIG. 1.

The rigid support frame 44 is partially embedded in the shoe sole 32 to reinforce the shoe sole 32. In particular, the cleat attachment section 50 is at least partially embedded in the shoe sole 32. In the illustrated embodiment, as best shown in FIG. 2, the cleat attachment section 50 is entirely embedded in the shoe sole 32 at the toe area 12 of the bicycle shoe 10, thereby reinforcing the shoe sole 32 at the toe area 12 of the bicycle shoe 10 to which the cleat 42 is mounted. As shown in FIGS. 3 and 4, the cleat attachment section 50 basically has a curved plate with a plurality of (e.g., three in FIG. 3) threaded holes 50*a*. The screws 43 extends through two through holes 32*c* of the shoe sole 32, and are threaded into the threaded holes 50*a* to secure the cleat 42 to the shoe sole 32. Alternatively, the cleat attachment section 50 can further include a metal attachment plate with threaded holes for the screws 43. The attachment plate is embedded within the cleat attachment section 50 to reinforce the thread connection of the screws 43. In this case, the screws 43 are threaded into the threaded holes of the attachment plate, instead of the threaded holes of the cleat attachment section 50.

The cleat attachment section 50 is dimensioned such that the cleat attachment section 50 is durable to maintain the secure connection between the cleat attachment section 50 and the cleat 42 even if the cleat 42 is pulled away from the cleat attachment section 50 while pedaling. The cleat attachment section 50 is also dimensioned such that the cleat attachment section 50 transmits pedaling force from the rider's foot 20 to the pedal via the cleat 42.

Figure 5:
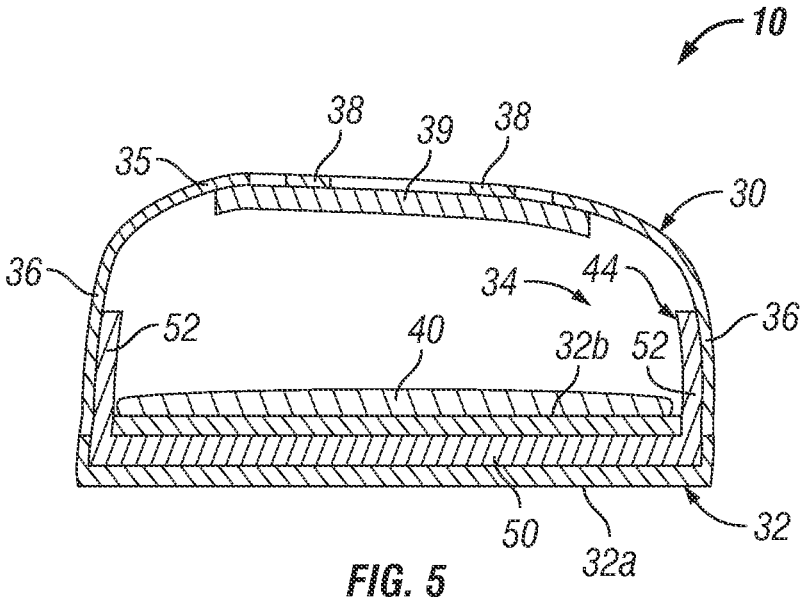
FIG. 5 is a transverse cross sectional view of the bicycle shoe illustrated in FIG. 1, taken along V-V line in FIG. 2.
Figure 6:
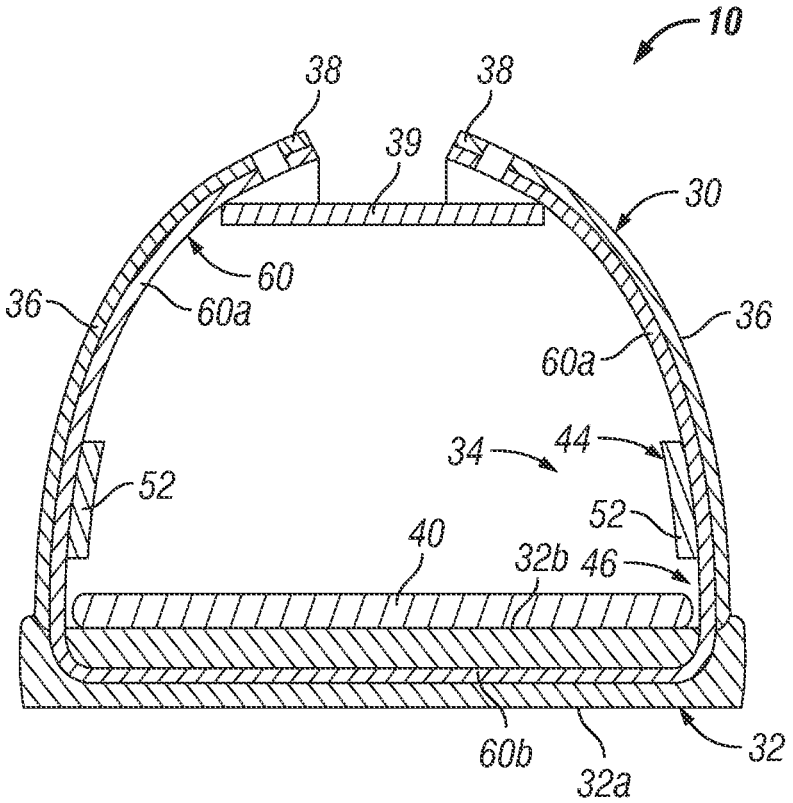
FIG. 6 is a transverse cross sectional view of the bicycle shoe illustrated in FIG. 1, taken along VI-VI line in FIG. 2.

The side sections 52 longitudinally extend between the cleat attachment section 50 and the heel section 54 to define a foot receiving space 58 therebetween. As best seen in FIG. 5, the side sections 52 extend upward from transverse edges of the cleat attachment section 50, and extend rearward towards the heel section 54. The side sections 52 also extend along the side portions 36 of the shoe upper 30, respectively. In the illustrated embodiment, the side sections 52 are directly fixed to inner surfaces of the side portions 36 of the shoe upper 30 with stitching, adhesives or any other suitable fixing manner, respectively, except for locations where the flexible support member 46 is disposed. As best shown in FIG. 6, the side sections 52 are directly fixed to inner surfaces of the flexible support member 46 with stitching, adhesives or any other suitable fixing manner, respectively, at locations where the flexible support member 46 is disposed. Alternatively, the side sections 52 can also be fixed to outer surfaces of the flexible support member 46.

The heel section 54 is arranged with respect to the cleat attachment section 50. The heel section 54 is basically formed as a U-shaped part in a top plan view. The heel section 54 extends between rear ends of the side sections 52. As a result, the cleat attachment section 50, the side sections 52 and the heel section 54 define a single aperture with a closed periphery through which a part of the rider's foot 20 is disposed while the rider wears the bicycle shoe 10. The side sections 52 and the heel section 54 extend along the side portions 36 and the heel portion 37 of the shoe upper 30. In particular, the side sections 52 and the heel section 54 extend along inner periphery of the bicycle shoe 10 defined by the side portions 36 and the heel portion 37 of the shoe upper 30. The heel section 54 is arranged such that the heel section 54 at least covers the most projecting portion of the heel portion 26 of the rider's foot 20 while the rider wear the bicycle shoe 10.

In the illustrated embodiment, the rigid support frame 44 is made of rigid material. For efficiently transferring pedaling power from the rider's foot 20 to the bicycle pedal, the positions of the toe area 12 and the heel area 16 of the bicycle shoe 10 need to be stationary with respect to the bicycle pedal along a longitudinal axis of the bicycle shoe 10 during pedaling. With the rigid support frame 44, the cleat attachment section 50 and the heel section 54 are rigidly connected to each other via the side sections 52. Thus, the positions of the toe area 12 and the heel area 16 of the bicycle shoe 10, which are defined by the cleat attachment section 50 and the heel section 54 of the rigid support frame 44, can be stationary with respect to the bicycle pedal that is engaged with the cleat 42 of the bicycle shoe 10.

In the illustrated embodiment, the side sections 52 longitudinally extend between the balls of the rider's foot 20 and the heel portion 26 of the rider's foot 20 along the both side portions 36 of the shoe upper 30, respectively. The side sections 52 enhance the vertical and lateral stiffness of the bicycle shoe 10 for efficient pedaling. In particular, the side sections 52 suppress the lateral or torsional deformation of the bicycle shoe 10, and enhance the pedaling power transmission from the rider's foot 20 to the bicycle pedal.

As mentioned above, the inner liner 40 is disposed on the upper surface 32*b* of the shoe sole 32 at the toe area 12, the arch area 14 and the heel area 16 of the bicycle shoe 10. Thus, as best seen in FIG. 5, the inner liner 40 at least partly covers the rigid support frame 44 above the cleat attachment section 50, and is positioned inwardly relative to the cleat attachment section 50 of the rigid support frame 44. On the other hand, the inner liner 40 can only be disposed at the toe area 12 of the bicycle shoe 10 above the cleat attachment section 50.

As best seen FIG. 2, the flexible support member 46 is fixed to the rigid support frame 44, and at least partially extends beneath the foot receiving space 58. In particular, the flexible support member 46 has an arch support strap 60 and a heel support strap 62. The flexible support member 46, i.e., the arch support strap 60 and the heel support strap 62, is made of woven nylon, or any other soft and flexible material suitable for supporting the rider's foot 20, such as a non-stretchable nylon. Thus, the rigid support frame 44 and the flexible support member 46 are made of different materials.

As shown in FIGS. 3 and 4, the arch support strap 60 and the heel support strap 62 are fixedly attached to the side sections 52 and the heel section 54 of the rigid support frame 44, respectively. In particular, in the illustrated embodiment, the arch support strap 60 and the heel support strap 62 are hanged relative to the side sections 52 and the heel section 54 of the rigid support frame 44 in a suspending manner such that the rider's foot 20 is hanged with respect to the rigid support frame 44 between the side sections 52 of the rigid support frame 44. Furthermore, the flexible support member 46, i.e., the arch support strap 60 and the heel support strap 62, is partially embedded in the shoe sole 32 at the arch area 14 and the heel area 16 of the bicycle shoe 10, respectively.

As best shown in FIG. 6, the arch support strap 60 extends between the side sections 52 of the rigid support frame 44 at the arch area 14 of the bicycle shoe 10. In particular, the arch support strap 60 has a pair of side sections 60*a* and a bottom section 60*b* that extends between lower edges of the side sections 60*a*. The arch support strap 60 is formed as a one-piece, unitary member. Alternatively, the arch support strap 60 can also be formed from a plurality of separate members.

The side sections 60*a* of the arch support strap 60 extend upward relative to the bottom section 60*b* along the side portions 36 of the shoe upper 30, respectively. In particular, the side sections 60*a* continuously extend upward along the side portions 36 of the shoe upper 30, respectively, from the shoe sole 32 to the lacing portions 38 of the shoe upper 30. The side sections 60*a* are fixedly attached to the side portions 36 of the shoe upper 30, respectively, with stitching, adhesives, or any other suitable fixing manner. Furthermore, the side sections 60*a* are partially attached to the side sections 52 of the rigid support frame 44. In particular, as shown in FIG. 6, middle area of inner surfaces of the side sections 60*a* are fixedly attached to the side sections 52 of the rigid support frame 44, respectively, with stitching, adhesives, or any other suitable fixing manner. Thus, in the illustrated embodiment, upper parts of the side sections 60*a* extend upward relative to the side sections 52 of the rigid support frame 44, respectively. The bottom section 60*b* of the arch support strap 60 is entirely embedded within the shoe sole 32 at the arch area 14 of the bicycle shoe 10. Thus, the bottom section 60*b* laterally extends beneath the foot receiving space 58. The bottom section 60*b* connects the side sections 60*a* relative to each other.

With this arch support strap 60, when the lacing portions 38 are tightened up towards one another, then the arch support strap 60 is securely wrapped around the arch portion 24 of the rider's foot 20, and fastened to the arch portion 24 of the rider's foot 20. Specifically, when the lacing portions 38 are tightened up towards one another, the upper parts of the side sections 60*a* are fastened against the top of the arch portion 24 of the rider's foot 20, while the bottom section 60*b* is fastened against the bottom of the arch portion 24 of the rider's foot 20. In particular, the shoe sole 32 is made of rubber or any suitable soft material at the arch area 14 of the bicycle shoe 10. Thus, while the bottom section 60*b* supports the arch portion 24 of the rider's foot 20 with respect to the rigid support frame 44, the bottom section 60*b* also fastens the shoe sole 32 at the arch area 14 of the bicycle shoe 10 against the bottom of the arch portion 24 of the rider's foot 20 such that the upper surface 32*b* of the shoe sole 32 is fitted to the shape of the bottom of the arch portion 24 of the rider's foot 20. Furthermore, in the illustrated embodiment, the arch support strap 60 is secured to the rigid support frame 44. Thus, the arch support strap 60 secures the arch portion 24 of the rider's foot 20 with respect to the rigid support frame 44 while the rider wears the bicycle shoe 10.

As best shown in FIG. 4, the heel support strap 62 is fixedly coupled to the heel section 54 of the rigid support frame 44, and loops back about the heel portion 26 of the rider's foot 20. The heel support strap 62 is made of soft material suitable for holding and surrounding the calcaneus bone of the heel portion 26 of the rider's foot 20. In particular, the heel support strap 62 has a pair of side sections 62*a* and a bottom section 62*b* that extends between lower edges of the side sections 62*a*. The heel support strap 62 is preferably formed as a one-piece, unitary member. Alternatively, the heel support strap 62 can also be formed from a plurality of separate members.

The side sections 62*a* of the arch support strap 60 extend upward and rearward relative to the bottom section 62*b* towards the heel portion 37 of the shoe upper 30, respectively. In particular, the side sections 62*a* continuously extend upward and rearward relative to the bottom section 62*b* from the shoe sole 32 to the heel portion 37, respectively. The side sections 62*a* are fixedly attached to the heel portion 37 of the shoe upper 30, respectively, with stitching, adhesives, or any other suitable fixing manner. Furthermore, the side sections 62*a* are partially attached to the heel section 54 of the rigid support frame 44. In particular, as shown in FIG. 4, inner surfaces of upper parts of the side sections 62*a* are fixedly attached to the heel section 54 of the rigid support frame 44, respectively, with stitching, adhesives, or any other suitable fixing manner. Thus, in the illustrated embodiment, the side sections 62*a* extend downward relative to the heel section 54 of the rigid support frame 44, respectively. The bottom section 62*b* of the heel support strap 62 is entirely embedded within the shoe sole 32 at the heel area 16 of the bicycle shoe 10. The bottom section 62*b* connects the side sections 62*a* relative to each other.

With this heel support strap 62, when the rider puts on the bicycle shoe 10, then the heel support strap 62 is securely wrapped around the heel portion 26 of the rider's foot 20, and fastened to the heel portion 26 of the rider's foot 20. Specifically, when the lacing portions 38 are tightened up towards one another, the bottom section 62*b* is fastened against the bottom of the heel portion 26 of the rider's foot 20. In particular, the shoe sole 32 is made of rubber or any suitable soft material at the heel area 16 of the bicycle shoe 10. Thus, while the bottom section 62*b* supports the heel portion 26 of the rider's foot 20 with respect to the rigid support frame 44, the bottom section 62*b* also fastens the shoe sole 32 at the heel area 16 of the bicycle shoe 10 against the bottom of the heel portion 26 of the rider's foot 20 such that the upper surface 32*b* of the shoe sole 32 is fitted to the shape of the bottom of the heel portion 26 of the rider's foot 20. Furthermore, in the illustrated embodiment, the heel support strap 62 is secured to the rigid support frame 44. Thus, the heel support strap 62 secures the heel portion 26 of the rider's foot 20 with respect to the rigid support frame 44 while the rider wears the bicycle shoe 10.

With the flexible support member 46, the arch support strap 60 and the heel support strap 62 are made of soft material. Thus, the arch support strap 60 and the heel support strap 62 can fittedly support the rider's foot 20 while the rider wears the bicycle shoe 10. In particular, the arch support strap 60 of the flexible support member 46 is made of soft material suitable for holding or wrapping around the arch portion 24 of the rider's foot 20. Thus, even if the rider's foot 20 is a spread feet, the arch support strap 60 is fastened around the arch portion 24 of the rider's foot 20 along the girth of the rider's foot 20 such that the arch support strap 60 fittedly support the rider's foot 20.

Conventional fixing straps or other fastening structure of the conventional bicycle shoes only fasten the rider's feet against rigid shoe soles of the bicycle shoes. However, with the flexible support member 46, the arch support strap 60 extends around the arch portion 24 of the rider's foot 20 along the girth to wrap around the arch portion 24. Thus, the arch support strap 60 fastens the rider's foot 20 both upward and downward. As a result, the rider's foot 20 is fittedly secured to the bicycle shoe 10.

With the bicycle shoe support 34, the bicycle shoe 10 can be snugly fitted to the rider's foot 20. In particular, the arch portion 24 and the heel portion 26 of the rider's foot 20 can be fittedly secured to the bicycle shoe 10 by the arch support strap 60 and the heel support strap 62 of the bicycle shoe support 34.

With the bicycle shoe support 34, the rigid support frame 44 extends along an inner surface of the outer periphery of the shoe upper 30 defined by the side portions 36 and the heel portion 37 of the shoe upper 30. Thus, the rider's foot 20 can be securely supported relative to the bicycle shoe 10 in the transverse direction of the shoe upper 30.

With the bicycle shoe support 34, the bottom of the rider's foot 20 can be fittedly supported to the shoe sole 32 of the bicycle shoe 10 at the arch portion 24 and the heel portion 26 of the rider's foot 20. Conventionally, cushioning insoles are utilized to fill the spaces between the rider's feet and the hard shoe soles. The conventional cushioning insoles need to be formed to conform to the shape of the rider's feet. On the other hand, with the bicycle shoe support 34, the flexible support member 46 is fitted around the rider's foot 20 such that the flexible support member 46 conforms to the shape of the rider's foot 20. Thus, the rider's foot 20 can be fittedly supported relative to the bicycle shoe 10 even without a cushioning insole.

With the bicycle shoe support 34, an uniform pressure can be applied to the bottom of the rider's foot 20 at the arch portion 24 and the heel portion 26 of the rider's foot 20 since the arch portion 24 and the heel portion 26 of the rider's foot 20 are fittedly supported by the arch support strap 60 and the heel support strap 62 of the flexible support member 46, respectively.

Furthermore, the calcaneus bone of the heel portion 26 of the rider's foot 20 are securely fastened with respect to the bicycle shoe support 34. In particular, the calcaneus bone of the heel portion 26 of the rider's foot 20 are securely fastened with respect to the bicycle shoe support 34 by the heel section 54 of the rigid support frame 44 that extends along the outer periphery of the heel portion 26 of the rider's foot 20 and the heel support strap 62 of the flexible support member 46 that hangs from the rigid support frame 44 and extends beneath the bottom of the heel portion 26 of the rider's foot 20.

With the bicycle shoe support 34, the lateral stiffness of the bicycle shoe 10 can be sufficiently obtained. In particular, the bicycle shoe support 34 is formed as a rigid body. Thus, the lateral or torsional force exerted to the heel section 54 about the cleat attachment section 50 can also be directly transmitted to the cleat attachment section 50 through the side sections 52, thereby rotating the cleat attachment section 50 instead of deforming the side sections 52 or the heel section 54. Thus, less energy is lost or absorbed in the deformation of the bicycle shoe support 34. The engagement of the cleat 42 relative to the bicycle pedal is released by twisting the heel portion 26 of the rider's foot outward. Thus, releasing of the cleat 42 from the bicycle pedal can be properly performed with the bicycle shoe support 34.

In the illustrated embodiment, as best shown in FIG. 2, the cleat attachment section 50 of the rigid support frame 44 is entirely embedded in the shoe sole 32 at the toe area 12 of the bicycle shoe 10. In other words, the cleat attachment section 50 of the rigid support frame 44 is disposed between the upper surface 32*b* and the bottom surface 32*a* of the shoe sole 32 at the toe area 12 of the bicycle shoe 10. Alternatively, the cleat attachment section 50 of the rigid support frame 44 can be overlaid on the shoe sole 32. In particular, the cleat attachment section of the rigid support frame 44 can be disposed on the upper surface 32*b* of the shoe sole 32 at the toe area 12 of the bicycle shoe 10. In this case, the cleat attachment section 50 of the rigid support frame 44 is fixedly attached to the upper surface 32*b* of the shoe sole 32 with stitching, adhesives or any other suitable fixing manner.

In the illustrated embodiment, as best shown in FIG. 2, the arch support strap 60 and the heel support strap 62 are partially embedded in the shoe sole 32 at the arch area 14 and the heel area 16 of the bicycle shoe 10, respectively. In other words, the bottom section 60*b* of the arch support strap 60 and the bottom section 62*b* of the heel support strap 62 are disposed between the upper surface 32*b* and the bottom surface 32*a* of the shoe sole 32 at the arch area 14 and the heel area 16 of the bicycle shoe 10, respectively. Alternatively, the arch support strap 60 and the heel support strap 62 can be completely exposed, or can be completely covered (i.e., not exposed).

In particular, the bottom section 60*b* of the arch support strap 60 and the bottom section 62*b* of the heel support strap 62 can be disposed above the upper surface 32*b* of the shoe sole 32 at the arch area 14 and the heel area 16 of the bicycle shoe 10, respectively, such that the arch support strap 60 and the heel support strap 62 are completely exposed relative to the shoe sole 32. In this case, the bottom section 60*b* of the arch support strap 60 and the bottom section 62*b* of the heel support strap 62 directly support the bottom of the rider's foot 20 at the arch portion 24 and the heel portion 26, or indirectly support the bottom of the rider's foot 20 at the arch portion 24 and the heel portion 26 via the inner liner 40. Of course, only one of the arch support strap 60 and the heel support strap 62 can be completely exposed relative to the shoe sole 32.

Furthermore, the shoe sole 32 can be extended upward along the side portions 36 of the shoe upper 30 such that the arch support strap 60 and the heel support strap 62 are completely covered by the shoe sole 32. In this case, the side sections 60*a* and the bottom section 60*b* of the arch support strap 60 and the side sections 62*a* and the bottom section 62*b* of the heel support strap 62 are completely embedded within the shoe sole 32. Of course, only one of the arch support strap 60 and the heel support strap 62 can be completely covered by the shoe sole 32. Moreover, the inner liner 40 can be extended upward along the side portions 36 of the shoe upper 30 such that the arch support strap 60 and the heel support strap 62 are completely covered by the inner liner 40. In this case, the side sections 60*a* of the arch support strap 60 and the side sections 62*a* of the heel support strap 62 are disposed between the inner liner 40 and inner surfaces of the side portions 36 of the shoe upper 30, while the bottom section 60*b* of the arch support strap 60 and the bottom section 62*b* of the heel support strap 62 are disposed between the inner liner 40 and the upper surface 32*b* of the shoe sole 32. Of course, only one of the arch support strap 60 and the heel support strap 62 can be completely covered by the inner liner 40.

In the illustrated embodiment, as best seen in FIG. 2, the inner liner 40 partially covers the rigid support frame 44. In particular, the inner liner 40 only covers the cleat attachment section 50 of the rigid support frame 44 at the toe area 12 of the bicycle shoe 10. Alternatively, the inner liner 40 can completely cover the rigid support frame 44. In particular, the inner liner 40 can be extended upward such that the inner liner 40 is inwardly located relative to the side sections 52 and the heel section 54 of the rigid support frame 44. In this case, the side sections 52 of the rigid support frame 44 are disposed between the inner liner 40 and inner surfaces of the side portions 36 of the shoe upper 30, while the heel section 54 of the rigid support frame 44 is disposed between the inner liner 40 and an inner surface of the heel portion 37 of the shoe upper 30. Of course, only one of the side sections 52 and the heel section 54 can be completely covered by the inner liner 40.

In the illustrated embodiment, as best shown in FIGS. 3 and 4, the arch support strap 60 is outwardly located relative to the side sections 52 of the rigid support frame 44. Alternatively, the arch support strap 60 can be inwardly located relative to the side sections 52 of the rigid support frame 44. In particular, outer surfaces of the side sections 60*a* of the arch support strap 60 can be fixedly attached to inner surfaces of the side sections 52 of the rigid support frame 44. Furthermore, in the illustrated embodiment, as best shown in FIGS. 3 and 4, the heel support strap 62 is outwardly located relative to the heel section 54 of the rigid support frame 44. Alternatively, the heel support strap 62 can be inwardly located relative to the heel section 54 of the rigid support frame 44. In particular, outer surfaces of the side sections 62*a* of the heel support strap 62 can be fixedly attached to inner surface of the heel section 54 of the rigid support frame 44. In these cases, the arch support strap 60 and the heel support strap 62 prevent the rigid support frame 44 from directly contacting with and rubbing the rider's foot 20.

In the illustrated embodiment, as best shown in FIG. 6, the upper parts of the side sections 60*a* of the arch support strap 60 extend upward relative to the side sections 52 of the rigid support frame 44, respectively. Alternatively, the side sections 60*a* can only extend upward between the shoe sole 32 and the side sections 52 of the rigid support frame 44, respectively. In this case, the arch support strap 60 is only disposed on a lower side relative to the side sections 52 of the rigid support frame 44, and only extends between the side sections 52 such that the arch support strap 60 is hanged between the side sections 52. As a result, the top of the arch portion 24 of the rider's foot 20 is only covered by the side portions 36 of the shoe upper 30.

Second Embodiment

Figure 7:
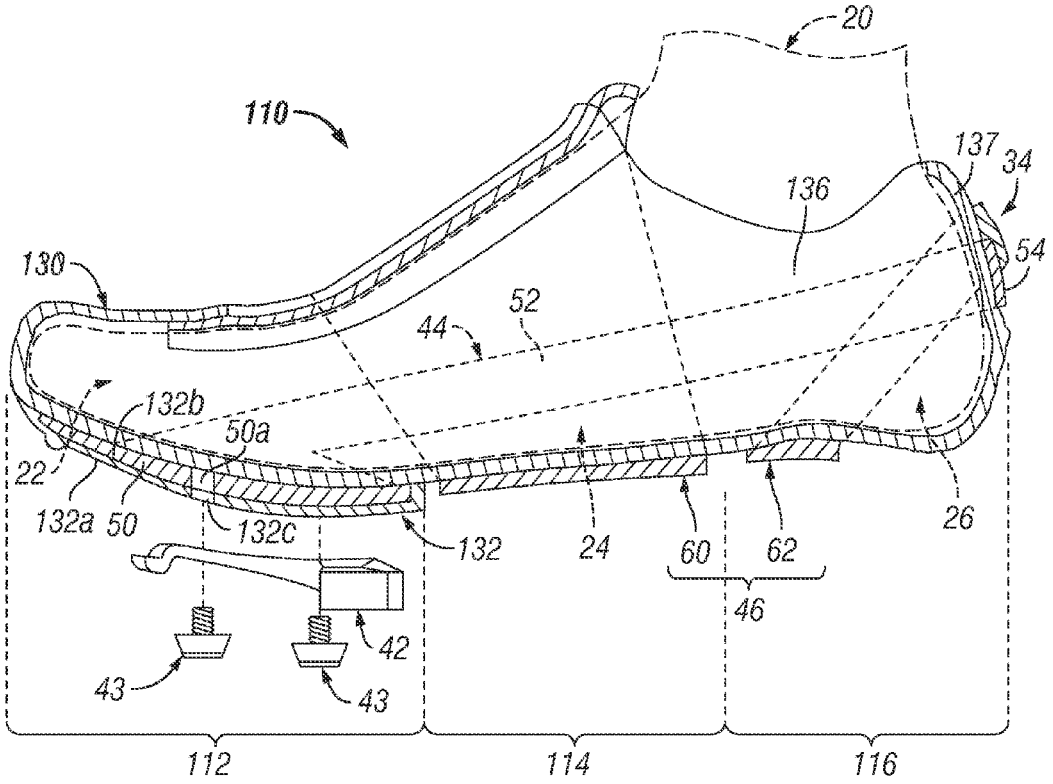
FIG. 7 is a longitudinal cross sectional view of a bicycle shoe having a bicycle shoe support in accordance with a second embodiment.

Referring now to FIG. 7, a bicycle shoe 110 in accordance with a second embodiment will now be explained. In view of the similarity between the first and second embodiments, the parts of the second embodiment that are identical to the parts of the first embodiment and functionally identical (but not exactly identical) to the parts of the first embodiment will be given the same reference numerals as the parts of the first embodiment. Accordingly, the descriptions of the parts of the second embodiment that are identical to the parts of the first embodiment and functionally identical (but not exactly identical) to the parts of the first embodiment may be omitted for the sake of brevity.

Basically, the bicycle shoe 110 in the second embodiment is identical to the first embodiment, and the only difference between the first embodiment and the second embodiment is that the bicycle shoe 110 has a shoe upper 130 that extends beneath the bottom of the rider's foot 20 to entirely cover the rider's foot 20, and a shoe sole 132 that is disposed only at a toe area 112 of the bicycle shoe 110. In other words, the shoe sole 132 is not disposed at an arch area 114 and a heel area 116 of the bicycle shoe 110. The bicycle shoe 110 further has the bicycle shoe support 34 in the first embodiment.

The shoe upper 130 is basically made of the same material as the shoe upper 30 in the first embodiment. The shoe upper 130 is basically formed of an expandable material. In particular, the shoe upper 130 is made of nylon mesh or any other flexible and elastic material that is utilized for conventional shoe uppers or socks. Thus, the top and the bottom of the rider's foot 20 are fittedly covered by the shoe upper 130.

The bicycle shoe support 34 is fixedly attached to the shoe upper 130. The rigid support frame 44 and the flexible support member 46 of the bicycle shoe support 34 is located outward relative to the shoe upper 130. In particular, the cleat attachment section 50 of the rigid support frame 44 is disposed beneath the bottom of the shoe upper 130 at the toe area 112 of the bicycle shoe 110. The side sections 52 and the heel section 54 of the bicycle shoe support 34 extends along an outer surface of an outer periphery of the shoe upper 130. The arch support strap 60 of the flexible support member 46 is outwardly located relative to side portions 136 of the shoe upper 130 to surround the girth of the shoe upper 130 at the arch area 114 of the bicycle shoe 110. The heel support strap 62 of the flexible support member 46 is outwardly located relative to a heel portion 137 of the shoe upper 130 to surround the heel portion 137 of the shoe upper 130 at the heel area 116 of the bicycle shoe 110. Thus, the rider's foot 20 can be fittedly supported to the bicycle shoe 10.

With this bicycle shoe 110, the shoe sole 132 is only be formed at a limited location for the purpose of pedaling. In particular, as mentioned above, the shoe sole 132 is only formed at the toe area 112 of the bicycle shoe 110, not formed at the arch area 114 and the heel area 116 of the bicycle shoe 110. The shoe sole 132 is fixedly coupled to the shoe upper 130 in a conventional manner, such as with stitching, adhesives, and/or embedding portions thereof within the shoe sole 132. The shoe sole 132 is made of rubber or any suitable soft material to support the shoe upper 130. In the illustrated embodiment, the shoe sole 132 is integrally formed as a one-piece, unitary member having a uniform rigidity. The shoe sole 132 is at least partially reinforced by the rigid support frame 44 at the toe area 112 of the bicycle shoe 110. In particular, the cleat attachment section 50 of the rigid support frame 44 is overlaid on an upper surface 132*b* of the shoe sole 132. The cleat attachment section 50 is fixedly coupled to the upper surface 132*b* of the shoe sole 132 with stitching, adhesives, and/or partially embedding portions thereof within the shoe sole 132. The bicycle shoe 110 is utilized with the cleat 42 and screws 43. Thus, the shoe sole 132 has a plurality of (e.g., three in this embodiment) through holes 132*c* through which the screws 43 extend and are threaded into the threaded holes 50*a* of the cleat attachment section 50 to secure the cleat 42 relative to a bottom surface 132*a* of the shoe sole 132.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

While only selected embodiments have been chosen to illustrate the present invention, it will be apparent to those skilled in the art from these disclosures that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A bicycle shoe support comprising:

a rigid support frame including a cleat attachment section, the cleat attachment section including at least one screw engaging part configured to engage with a screw to secure a bicycle cleat underneath the cleat attachment section in a vertical direction of the bicycle shoe support, a heel section arranged with respect to the cleat attachment section, the heel section having an open U-shape in a top plan view, the heel section being positioned higher than the cleat attachment section in the vertical direction of the bicycle shoe support and rearward of the cleat attachment section in a longitudinal direction of the bicycle shoe support, and a pair of side sections longitudinally extending between the cleat attachment section and the heel section, the cleat attachment section, the heel section, and the pair of side sections defining a rigid body having a single aperture with a closed periphery; and a flexible support member configured and arranged to span from one of the side sections to the other of the side sections and pass beneath the aperture, the flexible support member being made of a material that is less rigid than the rigid support frame, the heel section and the side sections of the rigid support frame being arranged inside a shoe upper of a bicycle shoe.

2. The bicycle shoe support according to claim 1, wherein the flexible support member is fixedly attached to the side sections of the rigid support frame.

3. The bicycle shoe support according to claim 1, wherein the flexible support member has an arch support strap that extends between the side sections of the rigid support frame, the arch support strap being configured to secure an arch portion of a rider's foot with respect to the rigid support frame.

4. The bicycle shoe support according to claim 3, wherein the flexible support member further has a heel support strap that is configured to secure a heel portion of the rider's foot with respect to the rigid support frame.

5. The bicycle shoe support according to claim 4, wherein the heel support strap is fixedly coupled to the heel section of the rigid support frame.

6. The bicycle shoe support according to claim 1, wherein the flexible support member is made of woven nylon.

7. The bicycle shoe support according to claim 1, wherein the side sections extend diagonally rearward and upward from the cleat attachment section toward the heel section such that the heel section is disposed higher than the cleat attachment section.

8. The bicycle shoe support according to claim 1, wherein the flexible support member is disposed between the cleat attachment section and the heel section in a longitudinal direction of the side sections.

9. The bicycle shoe support according to claim 1, wherein the rigid support frame is made from a material selected from the group consisting of carbon graphite, glass fiber, injection-molding resin, and metal.

10. The bicycle shoe support according to claim 9, wherein the flexible support member is made of woven nylon.

11. A bicycle shoe support comprising:

a rigid support frame including a cleat attachment section having a curved plate shape, the cleat attachment section including at least one screw engaging part configured to engage with a screw to secure a bicycle cleat underneath the cleat attachment section in a vertical direction of the bicycle shoe support, a heel section arranged opposite the cleat attachment section in a longitudinal direction of the bicycle shoe support, the heel section having an open U-shape in a top plan view, the heel section being positioned higher than the cleat attachment section in the vertical direction of the bicycle shoe support and rearward of the cleat attachment section in a longitudinal direction of the bicycle shoe support, and a pair of side sections longitudinally extending between the cleat attachment section and the heel section, the side sections being joined to upwardly curved portions of the cleat attachment section, the rigid support frame being integrally formed as a one-piece, unitary rigid body with the cleat attachment section, the heel section, and the pair of side sections defining a single aperture with a closed periphery; and a flexible support member extending beneath the aperture, the heel section and the side sections of the rigid support frame being arranged inside a shoe upper of a bicycle shoe.

12. The bicycle shoe support according to claim 11, wherein a tip of cleat attachment section projects diagonally upward and away from the heel section in a side view of the bicycle shoe support.

13. A bicycle shoe comprising:

a shoe upper made of a first material, the shoe upper having a side portion defining an inboard side and an outboard side of the bicycle shoe with a foot receiving space between the inboard and outboard sides;

a shoe sole coupled to the shoe upper; and a bicycle shoe support having:

a rigid support frame made of a second material having a higher rigidity than the first material, the rigid support frame being formed as a rigid body including a cleat attachment section, the cleat attachment section including at least one screw engaging part configured to engage with a screw to secure a bicycle cleat underneath the cleat attachment section in a vertical direction of the bicycle shoe support, a heel section arranged opposite the cleat attachment section in a longitudinal direction of the bicycle shoe, the heel section being positioned higher than the cleat attachment section in the vertical direction of the bicycle shoe support and rearward of the cleat attachment section in a longitudinal direction of the bicycle shoe support, and a pair of side sections longitudinally extending between the cleat attachment section and the heel section, the heel section and the side sections of the rigid support frame extending along the side portion of the shoe upper, and a flexible support member made of a third material that is softer and less rigid than the second material, the flexible support member extending in a girth direction of the bicycle shoe so as to span from the inboard side to the outboard side of the bicycle shoe and pass beneath the foot receiving space, the heel section and the side sections of the rigid support frame of the bicycle shoe support are arranged inside the shoe upper.

14. The bicycle shoe according to claim 13, wherein the bicycle shoe support defines a toe area of the bicycle shoe that is configured to receive a toe portion of a rider's foot, a heel area of the bicycle shoe that is configured to receive a heel portion of the rider's foot, and an arch area of the bicycle shoe that is positioned between the toe area and the heel area and configured to receive an arch portion of the rider's foot, the shoe sole being disposed in the toe area and not disposed in the arch area and the heel area.

15. The bicycle shoe according to claim 14, wherein the cleat attachment section of the rigid support frame of the bicycle shoe support is overlaid on the shoe sole.

16. The bicycle shoe according to claim 13, wherein the shoe upper is formed of an expandable material.

17. The bicycle shoe according to claim 13, wherein the cleat attachment section of the rigid support frame of the bicycle shoe support is at least partially embedded in the shoe sole.

18. The bicycle shoe according to claim 13, wherein the cleat attachment section of the rigid support frame of the bicycle shoe support is overlaid on the shoe sole.

19. The bicycle shoe according to claim 13, wherein the flexible support member of the bicycle shoe support is partially embedded in the shoe sole.

20. The bicycle shoe according to claim 13, wherein the rigid support frame of the bicycle shoe support is integrally formed as a one-piece, unitary member.

21. The bicycle shoe according to claim 13, wherein the flexible support member of the bicycle shoe support is made of woven nylon.

22. The bicycle shoe according to claim 13, wherein a bottom portion of the cleat attachment section is covered by the shoe sole.

* * * * *